United States Patent [19]

Convain

[11] 3,960,192

[45] June 1, 1976

[54] TANK CAPABLE OF BEING CARRIED BY A HELICOPTER

[75] Inventor: Michel Convain, Bondues, France

[73] Assignee: S. A. Pronal, Roubaix, France

[22] Filed: Sept. 5, 1975

[21] Appl. No.: 610,855

[30] Foreign Application Priority Data

Sept. 26, 1974 France ..... 74.32461

[52] U.S. Cl. ..... 150/1

[51] Int. Cl.[2] ..... B65D 33/14

[58] Field of Search ..... 150/.5, 1

[56] References Cited

UNITED STATES PATENTS

| | | | |
|---|---|---|---|
| 1,335,607 | 3/1920 | Salisbury | 150/1 |
| 2,749,957 | 6/1956 | Smith | 150/1 |
| 2,751,954 | 6/1956 | Dryg | 150/1 |

*Primary Examiner*—Donald F. Norton

*Attorney, Agent, or Firm*—Holman & Stern

[57] ABSTRACT

The tank comprises a bag which has in plan and in the flat condition the shape of a square with rounded corners formed by the assembly of two walls of fabric coated with an elastomer. Two straps also of coated fabric and having equal lengths are each fixed by their respective ends to opposed edges of the bag and have a length slightly greater than the distance between the opposed edges. When the hooking ring disposed in the region of the crossing of the two straps is subjected to a traction by a line carried by a helicopter, each half strap assumes an oblique position so that, when the tank is raised and carried along with the helicopter, the whole of the tank assumes an aerodynamic profile which prevents any pendular or giratory movements in respect of speeds which may exceed 200 km per hour.

10 Claims, 7 Drawing Figures

TANK CAPABLE OF BEING CARRIED BY A HELICOPTER

The present invention relates to tanks capable of being carried by or suspended from helicopters comprising a bag having a flexible wall which has in the flat condition the shape of a regular polygon or a circle and is provided with suspension means.

Known tanks of this type whose suspension means comprise, for example, a net surrounding the bag, are unsatisfactory since, when the bag is suspended from a moving helicopter by a line, the tank undergoes pendular or giratory movements as soon as the speed exceeds 100 km per hour.

An object of the present invention is to overcome these drawbacks.

According to the invention there is provided a tank of the aforementioned type wherein the suspension means are constituted by crossed straps which are each fixed by their respective ends to two opposed edges of the bag and are interconnected in the crossing region of the straps where there is provided a single hooking means, the length of the straps being slightly greater than the distance between the corresponding edges in the flat state and each strap widening from the crossing region so that when viewed in plan, the two straps have approximately the shape of a Maltese Cross.

The very wide dimension that it is possible to give to the ends of the straps and consequently to the attachment of the straps to the bag, enables distributing the load to the maximum extent over the periphery of the bag. Moreover, the Maltese Cross shape of the two straps and the extra width of the straps give, when the helicopter moves in translation, an aerodynamic profile to the whole of the suspended tank which results in a stabilization and eliminates any pendular or giratory movement for a speed which may exceed 200 km per hour.

In order to compensate for the narrowing of the central region of the straps which are preferably of fabric coated with an elastomer, there is advantageously provided a reinforcement of the straps in said region, for example in the form of one or more additional layers of coated fabric. Jointly with the choice of the length of the straps this arrangement permits avoiding excessive stresses in the straps when the tank is put in suspension or when dropping the tank from a small height.

Furthermore, in the crossing region where the load is concentrated, the two straps are preferably clamped between stiffening plates, for example of steel, to one of which there is fixed a hooking ring.

It is particularly rational that the shape in plan of the bag normally adapted to contain a liquid be that of a square having rounded corners which offers for the attachment of each belt end between the two corresponding rounded corners a long length of side. The invention will be explained in the ensuing description with reference to the accompanying drawing in which.

Figure 2:
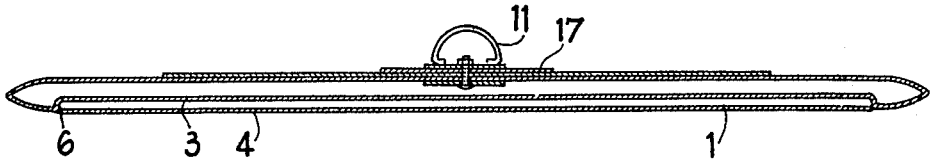
FIG. 2 is a sectional view taken on line 2—2 of FIG. 1.
Figure 1:
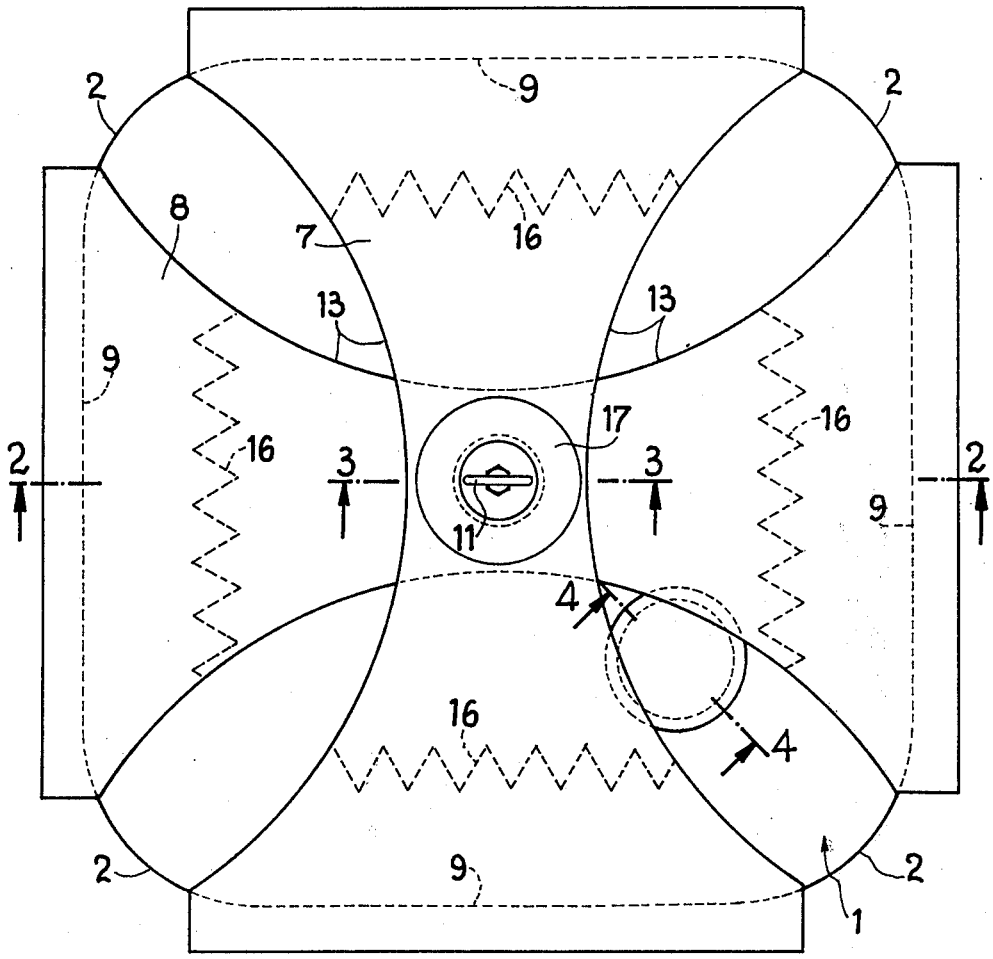
FIG. 1 is a plan view of a tank disposed in the flat condition.
Figure 3:
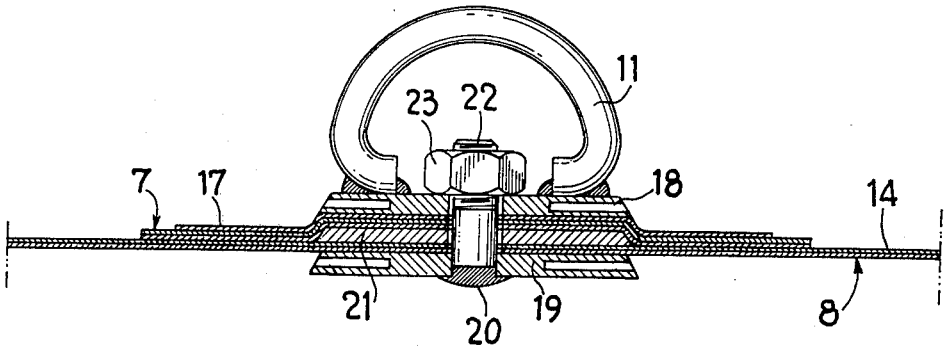
FIG. 3 is a sectional view, to an enlarged scale taken on line 3—3 of FIG. 1, of the hooking ring.
Figure 5:
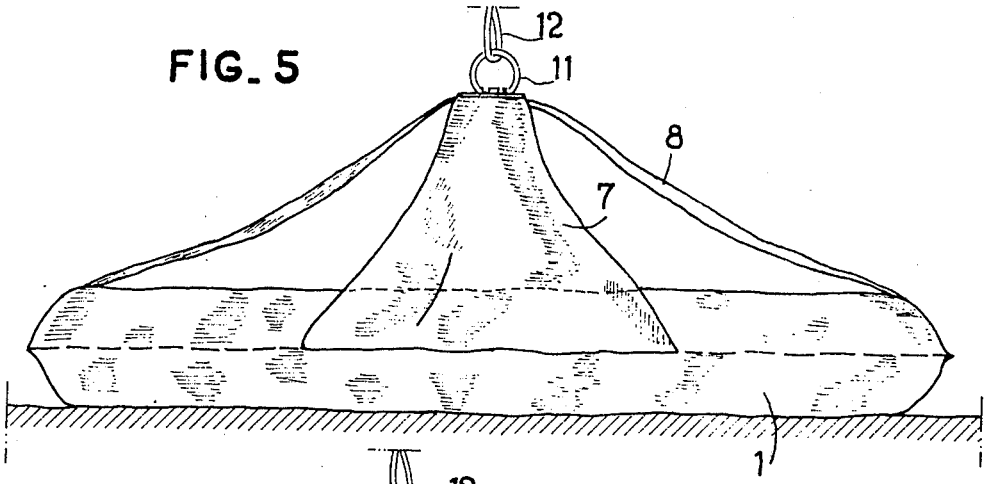
FIG. 5 is a diagrammatic perspective view of the filled tank resting on the ground.

The tank shown in the flat condition in FIGS. 1 and 2 comprises a container or bag 1 which has, in plan, the shape of a square with rounded corners 2 formed by the assembly of two walls of a fabric coated with elastomer 3, 4 by means of a surrounding or peripheral L-sectioned member 6. Two straps 7, 8 of fabric coated with elastomer cross at a right angle and have an equal length and are each fixed by their respective ends to the rectilinear part 9 of two opposed edges of the bag 1 by an adhesion in contact with the peripheral L-section member 6. Each strap 7, 8 has a length slightly greater than the distance between the two opposed edges 9 of the bag so that when the hooking ring 11 disposed in the crossing region of the two straps is subjected to the traction of a line 12, each half strap assumes an oblique position as shown in FIG. 5.

The two edges 13 of the straps 7, 8 have a concave shape defined by an arc of a circle of relatively large diameter so that the straps narrow from their ends toward the crossing region and the assembly thereof has in plan the shape of a Maltese Cross. In order to compensate for the narrowing of the two straps in their centre region, a layer of reinforcing coated fabric 14 is applied on these two straps in said region, which extends on each side of the crossing region to the limit defined by the zig-zag stitching line 16 visible in FIG. 1. An additional reinforcing layer in the form of a washer 17 also of coated fabric is provided in the crossing region itself.

The two straps are assembled in the crossing region by means of three stiffening plates 18, 19 and 21 comprising two end plates 18, 19, one being an outer upper plate 18 to which there is welded the hooking ring 11 and which is applied against the reinforcing washer 17 which is applied against the strap 7, the other being an inner lower plate 19 which is applied in contact with the strap 8, the intermediate plate 21 being sandwiched between the two straps 7, 8. The assembly formed by the stiffening plates and the reinforced straps has extending therethrough a bolt 22 whose head is welded to the inner plate 19 and whose upper screwthreaded end portion is provided with a nut 23 which is clamped in contact with the upper plate 18.

Figure 4:
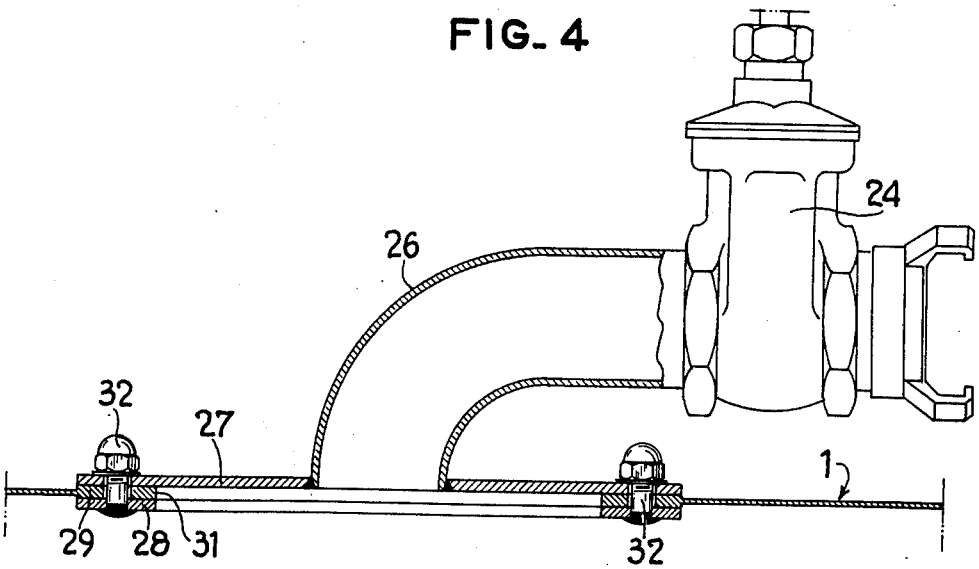
FIG. 4 is a sectional view, to an enlarged scale taken on line 4—4 of FIG. 1, of a supply valve.

FIG. 4 shows a valve 24 for filling and emptying the tank mounted on a pipe 26 welded to a circular plate 27 whose peripheral region clamps, in cooperation with an inner washer 28, the edge portion 29 of an opening 31 in the wall of the flexible bag 1 by means of bolts 32.

FIG. 5 shows the bag 1 filled with liquid resting on the ground in a position in which the hooking ring 11 is raised by the line 12.

Figure 6:
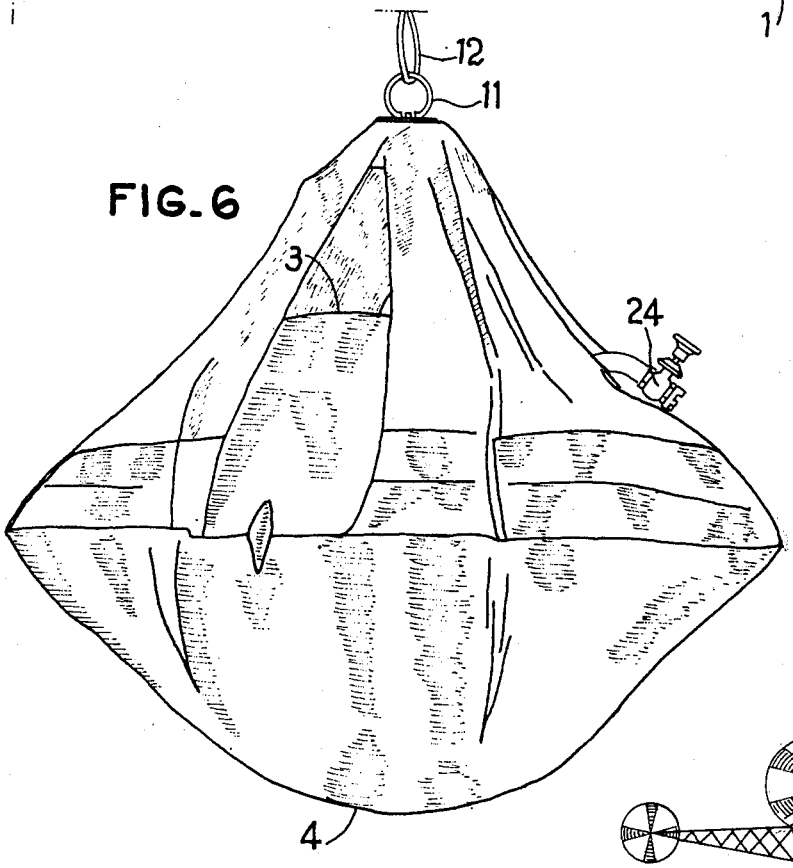
FIG. 6 is a view of the tank suspended from a helicopter which is stationary.

In FIG. 6 the tank is raised off the ground by the line 12 of the helicopter which is assumed to be stationary. The two walls 3, 4 are curved under the effect of the pressure of the liquid load and of the traction exerted by the belts, the tank assuming a roughly piriform appearance.

Figure 7:
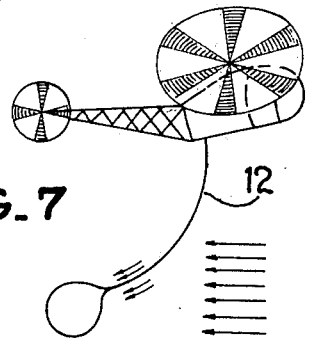
FIG. 7 is a diagrammatic view of the helicopter in movement and supporting the tank.

FIG. 7 shows diagrammatically the tank suspended from the line 12 when the helicopter moves in translation. Under the effect of the relative movement of the air and of the helicopter, the line 12 assumes a certain curvature and the tank assumes under the effect of the belts an aerodynamic profile which maintains it in a stable position for a speed of translation which may exceed 200 km per hour.

Having now described my invention what I claim as new and desire to secure by Letters Patent is:

1. A tank for being suspended from a helicopter and comprising a bag which has a flexible wall and has in plan in a flat condition substantially the shape of a regular polygon, suspension means for the bag, the suspension means being constituted by straps which cross in a region and are fixed by their respective ends to two opposed edges of the bag and are interconnected in the crossing region of the straps where there is provided a hooking means, the length of the straps being slightly greater than the distance between the corresponding opposed edges in the flat state of the bag and each strap widening from the crossing region so that the two straps when viewed in plan have substantially the shape of a Maltese Cross.

2. A tank as claimed in claim 1, wherein the two straps are of fabric coated with elastomer.

3. A tank as claimed in claim 1, wherein in the crossing region the two straps are reinforced.

4. A tank as claimed in claim 3, wherein the straps are reinforced in the crossing region by at least one additional layer of fabric coated with elastomer.

5. A tank as claimed in claim 1, wherein in the crossing region the two straps are clamped between two stiffening plates.

6. A tank as claimed in claim 5, wherein the hooking means is in the form of a hooking ring fixed to one of the plates.

7. A tank as claimed in claim 1, wherein the bag has in plan the shape of a square having rounded corners.

8. A tank as claimed in claim 7, wherein each strap end is fixed to the whole of the length of the corresponding side between the two rounded corners of the bag.

9. A tank as claimed in claim 1, wherein each strap is laterally defined by two arcs of a circle.

10. A tank for being suspended from a helicopter and comprising a bag which has a flexible wall and has in plan in a flat condition substantially the shape of a circle suspension means for the bag, the suspension means being constituted by straps which cross in a region and are each fixed by their respective ends to two opposed edges of the bag and are interconnected in the crossing region of the straps where there is provided a hooking means, the length of the straps being slightly greater than the distance between the corresponding opposed edges in the flat state of the bag and each strap widening from the crossing region so that the two straps when viewed in plan have substantially the shape of a Maltese Cross.

* * * * *